US008128431B2

(12) United States Patent
Kato et al.

(10) Patent No.: US 8,128,431 B2
(45) Date of Patent: Mar. 6, 2012

(54) CONNECTOR

(75) Inventors: Hajime Kato, Makinohara (JP); Tsuyoshi Mizushima, Makinohara (JP); Yoshiaki Ozaki, Makinohara (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 12/640,701

(22) Filed: Dec. 17, 2009

(65) Prior Publication Data

US 2010/0159743 A1 Jun. 24, 2010

(30) Foreign Application Priority Data

Dec. 24, 2008 (JP) ..... 2008-328648

(51) Int. Cl.
*H01R 13/40* (2006.01)

(52) U.S. Cl. ..... 439/587; 439/271

(58) Field of Classification Search ..... 439/559, 439/556, 587, 271, 275, 883
See application file for complete search history.

(56) References Cited

U.S. PATENT DOCUMENTS

| | | | | |
|---|---|---|---|---|
| 3,954,321 | A * | 5/1976 | Casper | 439/275 |
| 4,802,869 | A * | 2/1989 | Maue | 439/587 |
| 4,921,437 | A * | 5/1990 | Cooper et al. | 439/275 |
| 5,108,303 | A * | 4/1992 | Maeda et al. | 439/271 |
| 6,059,594 | A * | 5/2000 | Davis et al. | 439/275 |
| 7,041,907 | B2 * | 5/2006 | Miyazaki | 174/72 A |
| 7,077,676 | B2 * | 7/2006 | Matsumoto et al. | 439/271 |
| 7,094,098 | B2 * | 8/2006 | Miyazaki | 439/559 |
| 7,530,843 | B1 * | 5/2009 | Tesfay et al. | 439/587 |
| 2004/0266269 | A1 | 12/2004 | Miyazaki | |
| 2009/0098771 | A1 * | 4/2009 | Kim | 439/587 |
| 2009/0124123 | A1 * | 5/2009 | Takahashi | 439/587 |
| 2011/0086545 | A1 * | 4/2011 | Ishida | 439/587 |

FOREIGN PATENT DOCUMENTS

JP 2003-109702 A 4/2003

OTHER PUBLICATIONS

Chinese Office Action issued Dec. 8, 2011, in corresponding Application No. 200910249530.9.

* cited by examiner

*Primary Examiner* — Renee Luebke
*Assistant Examiner* — Larisa Tsukerman
(74) *Attorney, Agent, or Firm* — Sughrue Mion, PLLC

(57) ABSTRACT

A terminal comprising a plate shaped electrical connector including an engagement portion and an equipment portion, a ring shaped support member intimately attached to an outer periphery of the equipment portion and abutting to the engagement portion, and a ring shaped elastic seal intimately attached to the outer periphery of the equipment portion and adjacent to the support member from a side of the support member opposite a side abutting the engagement portion. Also, a connector comprising the terminal and a connector housing including a terminal space into which the terminal is inserted, the terminal space having an inner peripheral wall.

8 Claims, 4 Drawing Sheets

CONNECTOR

REFERENCE TO RELATED APPLICATION

This application claims priority from Japanese Patent Application No. 2008-328648 filed on Dec. 24, 2008, and the subject matter of which is incorporated herein by reference.

TECHNICAL FIELD

The present invention relates to a connector which has a structure to prevent liquid, such as water, oil, or the like, from intruding into a terminal space of a connector housing.

BRIEF DESCRIPTION OF RELATED ART

Related art JP-A-2003-109702 describes a connector, which has a structure to prevent liquid, such as water, oil, or the like, from intruding into a terminal space of a connector housing. FIG. 6 shows this related art.

The related connector 101 includes a terminal 123 which has a electrical connector 126 having a rectangular-plane shape, a connector housing 112 which has a terminal space 113 into which the terminal 123 is inserted, and a circular elastic seal 128 which is attached to a periphery of the electrical connector 126 of the terminal 123.

Liquid, such as water, oil, or the like, flow along the electrical connector 126 and may intrude into the terminal space 113. The liquid is blocked by the elastic seal 128 which is intimately attached to an inner periphery of the terminal space 113 and to an outer periphery of the electrical connector 126. Thus, the liquid intrusion into the terminal space 113 is prevented and a wire connection 124 is protected.

The elastic seal 128 is attached to a seal equipment portion 125 which is provided at a basal portion of the electrical connector 126. This seal equipment portion 125 is formed as a recess provided along a periphery of the basal portion. The elastic seal 128 is fitted into the seal equipment portion 125 so as not to be displaced relative to the electrical connector 126.

In this related art, there is a friction between the elastic seal 128 and the inner periphery of the terminal space 113 during insertion of the terminal 123 into the terminal space 113. This friction acts on the elastic seal 128 to recede relative to the electrical connector 126. In a case where the friction deforms the elastic seal 128 and the elastic seal 128 recedes and drops out from the seal equipment portion 125, the seal between the inner periphery of the terminal space 113 and the outer periphery of the electrical connector 126 against liquid intrusion may not be secured.

In the related art of JP-A-2003-109702, it is possible to prevent the elastic seal 128 from receding by making the recess of the seal equipment portion 125 deep and thereby making the attachment between the seal equipment portion 125 and the elastic seal 128 deep. In this case, however, the allowable current passing the terminal 123 becomes small since the cross section of the seal equipment portion 125 becomes small. In order to obtain a deeper attachment between the seal equipment portion 125 and the elastic seal 128 without making the cross section of the seal equipment portion 125 small, a thickness of both side portions of the seal equipment portion 125 should be made to be large. However, this makes the terminal 123 large.

Also, the formation of the seal equipment portion 125 requires press workings in two directions in order to form the recess along the whole periphery of a portion of the electrical connector 126. One is a press working in a thickness direction of the electrical connector 126. The other is a press working in a width direction. Therefore, the manufacturing of the connector 101 becomes costly.

SUMMARY

The present invention addresses the above described problems by providing a connector which has enough sealing ability to prevent liquid intrusion without reducing the allowable current, growing the size of the terminal and causing a high manufacturing cost.

A connector according to an illustrative aspect of an exemplary embodiment of the present invention includes a terminal including an electrical connector which includes an engagement portion and an equipment portion; a connector housing including a terminal space into which the terminal is inserted, the terminal space having an inner peripheral wall; a ring shaped support member intimately attached to an outer periphery of the equipment portion and having a side abutting to the engagement portion; and a ring shaped elastic seal intimately attached to the outer periphery of the equipment portion and the inner peripheral wall, and adjacent to the support member from a side of the support member opposite the side abutting the engagement portion.

A connector according to an illustrative aspect of an exemplary embodiment of the present invention includes a terminal including an electrical connector, the electrical connector including an engagement portion and an equipment portion; a connector housing including a terminal space into which the terminal is inserted, the terminal room having an inner peripheral wall; a ring shaped support member intimately attached to an outer periphery of the equipment portion and having a side abutting to the engagement portion; and a ring shaped elastic seal intimately attached to the outer periphery of the equipment portion and the inner peripheral wall, and adjacent to the support member from a side of the support member opposite the side abutting the engagement portion.

Preferably, the electrical connector has a plate shape.

Preferably, the rigidity of the support member is higher than the rigidity of the elastic seal.

Preferably, the engagement portion includes a projection which projects from a side of the plate shaped electrical connector in a width direction.

Preferably, the engagement portion includes a projection which projects from the plate shaped electrical connector in a thickness direction.

According to the above illustrative aspect of an exemplary embodiment of the present invention, the elastic seal is supported from its back side by the support member abutting the engagement portion. Thus, the elastic seal is prevented from receding relative to the electrical connector. Therefore, the sealing between the outer periphery of the electrical connector and the inner peripheral wall of the terminal space is secured.

Also, since the rigidity of the support member is higher than the rigidity of the elastic seal, a space for engagement between the engagement portion and the support member (space for abutment) for preventing the support member from receding relative to the electrical connector by the abutment for the engagement portion may be smaller than a case where only the elastic seal is used. Thereby, the growth in size of the terminal is prevented, and reduction in the cross-section of the electrical connector is prevented causing the amount of the allowable current to be kept constant.

Also, in a case where the engagement portion is a projection which projects from at least one side of the electrical connector in width direction thereof, or in a case where the engagement portion is a projection which projects from the electrical connector in the thickness direction thereof, the formation of the projection as the engagement portion is easier compared to a case where the recess is provided in the periphery of the electrical connector. Thus, the manufacturing cost for the connecter can be reduced. Also, the formation of the projection does not require the reduction in the cross-section of the electrical connector, which allows the amount of the allowable current flowing in the terminal to be kept constant.

As summarized above, the present invention provides a connector which has enough sealing ability to prevent liquid intrusion without reducing the allowable current, growing the size of the terminal, and causing a high manufacturing cost.

DETAIL DESCRIPTION OF THE EXEMPLARY EMBODIMENTS

Below an exemplary embodiment of the present invention is explained with reference to drawings.

Figure 1:
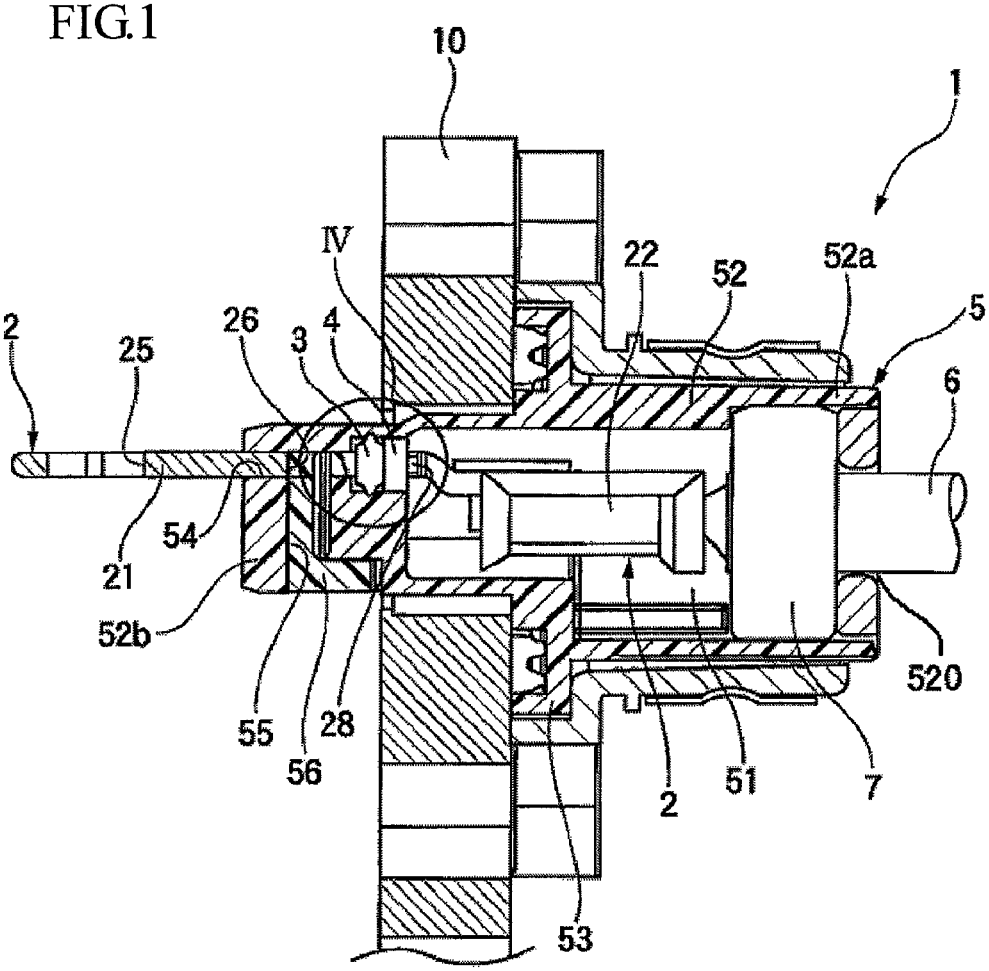
FIG. 1 is a sectional view of an exemplary embodiment of a connector according to the present invention.
Figure 2:
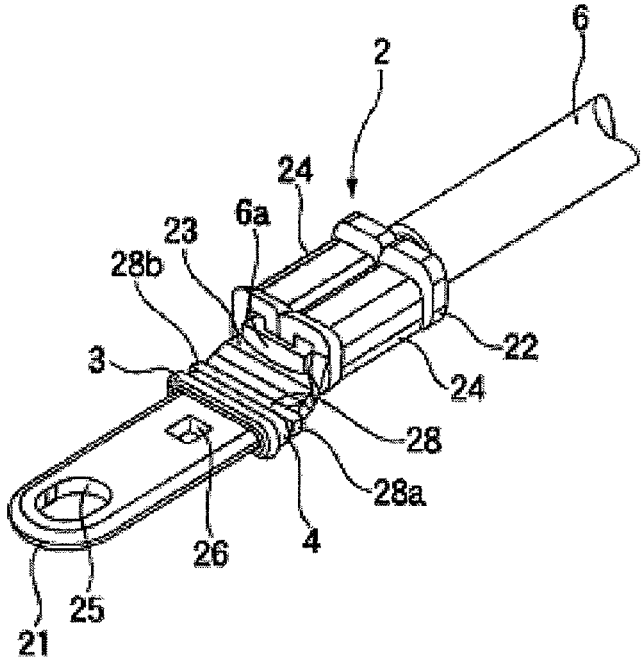
FIG. 2 is a perspective view of the exemplary embodiment of the connector shown in FIG. 1.
Figure 3:
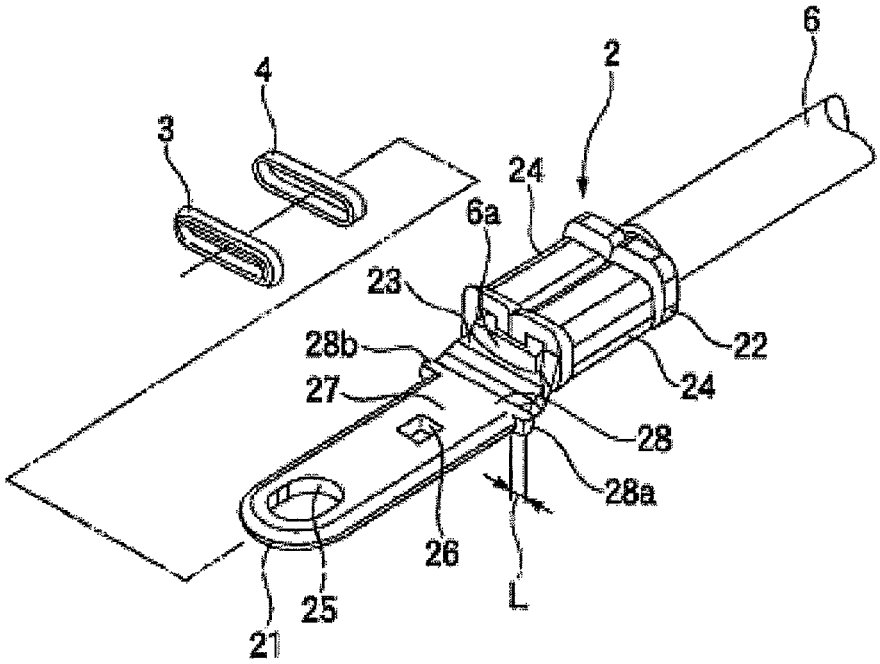
FIG. 3 is an exploded perspective view of a terminal shown in FIG. 2.

FIG. 1 is a sectional view of an exemplary embodiment of a connector according to the present invention. FIG. 2 is a perspective view of the exemplary embodiment of the connector shown in FIG. 1. FIG. 3 is an exploded perspective view of a terminal shown in FIG. 2.

A connector 1 includes a terminal 2 to which a wire 6 is connected, a connector housing having a terminal space 51 into which the terminal 2 is inserted, an elastic seal 3 which is attached to the terminal 2, and a supporting member 4. The connector 1 is attached to a chassis 10 of an apparatus.

The terminal 2 has an electrical connector 21 to which a counterpart connector is connected, and a wire connector 22 to which the wire 6 is connected (The counter part connector is not shown).

The connector housing 5 includes a body 52 and a flange 53. The body 52 defines the terminal space 51 in a rectangular column shape. The flange 53 is fixed on the chassis 10 while outwardly extending from a middle portion of the body 52. The body 52 of the connector housing 5 also includes a front end portion 52*b* and a rear end portion 52*a*. The rear end portion 52*b* has an opening 520 which continue to the terminal space 51. The front end portion 52*b* has a through hole 54 and an attachment hole 55. The through hole 54 extends along a column axis of the body 52 and penetrates the front end portion 52*b*. The attachment hole 55 extends in a direction perpendicular to the column axis from one of an outer surface of the front end portion 52*b*. Also, the attachment hole 55 reaches the through hole.

The electrical connector 21 passes through the through hole 54 while the terminal 2 is inserted in the terminal space 51. The electrical connecter 21 is retained by a retaining member 56 so as to prevent the terminal 2 from dropping out from the terminal space 51. The retaining member 56 is inserted into the attachment hole 55 and engaged with the electrical connector 21 in the through hole 54.

FIGS. 2 and 3 show the wire connector 22 and the electrical connector 21 with more detail. The wire connector 22 has a base 23 on which a conductor 6*a* of the wire is mounted, and a pair of swage pieces 24 which are continuously provided from both sides of the base 23. The pair of swage pieces 24 and the base 23 supports the conductor 6*a* while the pair of swage pieces 24 is bent so as to cover the conductor portion 6*a*. Thereby, the terminal 2 and the conductor 6*a* are electrically connected.

The electrical connector 21 of the terminal 2 is formed in a rectangular plate shape. One end in a longitudinal direction of the electrical connecter 21 is a basal portion. The basal portion is continued to the base 23 of the wire connector 22. A tip portion, which is the other end in the longitudinal direction of the electrical connecter 21, has rounded corners (in this embodiment, rounded to be an arc shape). The tip portion has a through hole 25, which penetrates the tip portion in a thickness direction. In a case where the terminal 2 and the counterpart connector are fastened by a screw, the screw passes the through hole 25. In another case, a projection provided on the counterpart connector may be engaged with the through hole 25.

At the middle of the electrical connector 21, a retaining hole 26 is provided. A tip of the retaining member 56 which is inserted into the attachment hole 55 is engaged with the retaining hole 26.

The basal portion of the electrical connector 21 is equipped with an elastic seal 3 and a support member 4. The electrical connector 21 has a plane shape with substantially constant thickness and width from the tip thereof (except for the rounded corners) to an equipment portion 27 to which the elastic seal 3 and the support member 4 are attached. The basal portion of the electrical connector 21 also has an engagement portion 28, which is adjacent to the equipment portion 27 from the basal side.

In the present embodiment, the engagement portion 28 includes a pair of projections 28*a* and 28*b*, which are projected from the both side of the basal portion of the electrical connector 21 by a predetermined length L in the width direction of the electrical connector 21. These projections 28*a* and 28*b*, for example, may be simultaneously formed when a metal plate, as a material for the terminal 2, is punched out. In other words, these projections 28*a* and 28*b* are formed by one press work in the thickness direction.

The elastic seal 3 is elastically deformable. One example material for the elastic material 3 is rubber. The elastic seal 3 has a ring shape and the inner circle of the ring shape is a little bit smaller than or the same size as a cross section of the electrical connector 21 so that the elastic seal 3 intimately contacts to an outer periphery of the electrical connector 21.

The support member 4 is formed from a resin, which has rigidity higher than that of the elastic seal 3. Because of its high rigidity, elastic deformations of the support member 4 are negligible as compared to those of the elastic seal 3. The support member 4 also has a ring shape and the inner circle of the ring shape is a little bit bigger than the cross section of the electrical connector 21 so that the electrical connecter 21 is smoothly inserted into the support member 4.

The elastic seal 3 and the support member 4 are equipped with the electrical connector 21 in the following manner. First the electrical connector 21 is inserted into the support member 4. Then the electrical connector 21 is inserted into the elastic seal 3. The support member 4 abuts the engagement portion 28 of the electrical connector 21 and is positively positioned at the equipment portion 27, which is adjacent to the electrical connector tip side of the engagement portion 28. The elastic seal 3 abuts the support member 4, which positions at the equipment portion 27 and the elastic seal 3 is positively positioned at the equipment portion 27 so as to be adjacent to the support member 4 from the tip side of the engagement portion 28.

The terminal 2, which is equipped with the elastic seal 3 and the support member 4, is inserted into the connector housing 5 through the opening 520 of the rear end portion 52*a* of the body 52. At this time, the terminal 2 is inserted into the connector housing 5 while the tip of the electrical connector 21 is protrudes (see FIG. 1). After the insertion, the end of the wire 6, which is connected to the electrical connector 22 of the terminal 2, is positioned at the rear end portion 52*a*. At the end of the wire 6, a ring shape seal member 7 is intimately attached on the periphery thereof. The seal member 7 is intimately attached to an outer periphery of an end portion of the wire 6 and to an inner peripheral wall of the rear end portion 52*a*. Thereby, the seal member 7 prevents liquid such as water, oil or the like from intruding into the terminal space 51 through the real end portion 52*a*.

The tip of the electrical connector 21 of the terminal 2 is inserted into the through hole 54 which is formed on the front end portion 52*b* of the body 52 and is projected from the front end portion 52 to outside of the connector housing 5. The middle portion of the electrical terminal 21, where the retaining hole 27 is provided, is positioned inside of the through hole. The tip of the retaining member 56, which is inserted into the attachment hole 55, is fitted into the retaining hole 26. Thereby, the retaining member 56 prevents the terminal 2 from dropping out from the terminal space 51.

The basal portion of the electrical connector 21 is positioned inside of the terminal space 51 and in a vicinity of the opening of the through hole 54. The elastic seal 3 attached to the basal portion of the electrical connector 21 intimately contacts to the outer periphery of the electrical connector 21 and the inner peripheral wall of the terminal space 51. Thereby, the elastic seal 3 prevents liquid such as water, oil, or the like from intruding into the terminal space 51 through the through hole 54.

Figure 4:
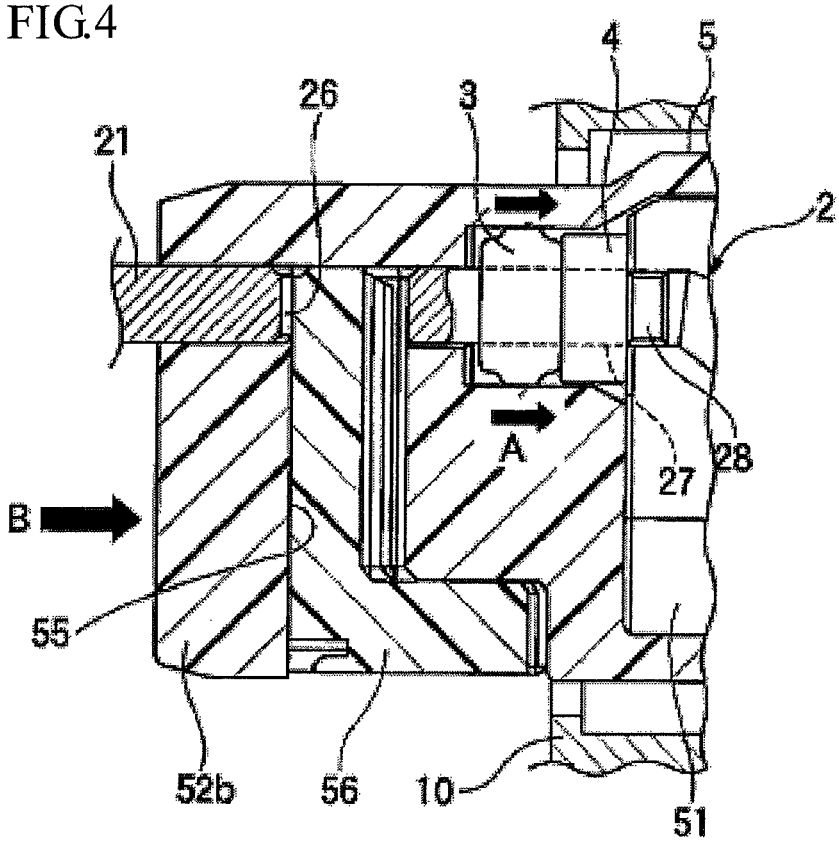
FIG. 4 is an expanded sectional view of a portion indicated by circle IV in FIG. 1.

As shown in FIG. 4, there is friction between the elastic seal 3 and the inner peripheral wall of the terminal space 51 during the insertion of the terminal 123 into the terminal space 51. The friction is indicated as an arrow A in FIG. 4.

Also, a force like a pressure of the liquid (indicated by arrow B) may act on the front end portion 52*b*, which is exposed from the chassis 10 of the apparatus. Therefore, the connector housing 5 recedes relative to the terminal 2 inserted into the terminal space 51. In this case, there is also a friction between the elastic seal 3 and the inner peripheral wall of the terminal space 51.

The above described friction A acts on the elastic seal 3 so as to recede relative to the electrical connector 21. The support member 4, however, is provided so as to be adjacent the elastic seal 3 from the backside. Since the support member 4 is retained by the engagement portion 28 of the electrical connector 21 from the backside, the support member 4 is prevented from receding relative to the electrical connector 21. Therefore, the elastic seal 3 is also prevented from receding relative to the electrical connector 21. Thus, the elastic seal 3 stays at the equipment portion 27 of the electrical connector 21. Thereby, the sealing between the outer periphery of the electrical connector 21 and the inner peripheral wall of the terminal space 51 is secured.

Since the support member 4 has higher rigidity than that of the elastic seal 3, the support member 4 deforms less than the elastic seal 3. Therefore, the engagement space (the length L of the pair of projections 28*a* and 28*b*) can be made smaller than a case where only the elastic seal 3 is provided. Thereby, the rigidity of the support member 4 prevents the terminal from growing in size.

The engagement portion 28 is formed as the pair of projection 28*a*, 28*b*, which is projected from both sides of the basal portion of the electrical connector 21 by a predetermined length L in the width direction of the electrical connector 21. The formation of the projections 28*a*, 28*b* does not require a reduction in the cross-section of the engagement portion. Thus, it is possible to maintain the amount of the allowable current. Also, these projections 28*a*, 28*b* can be formed by a press work in the thickness direction. Since only one direction press work is required, the manufacturing of the terminal 2 is relatively easy, and the cost for the manufacturing can be reduced.

The present invention is not limited to the above described embodiment and modifications are possible without departing from the spirit and the scope of the present invention. The materials, forms, dimensions, numbers, style, number, and disposition are arbitrary if the invention is achieved.

Figure 5:
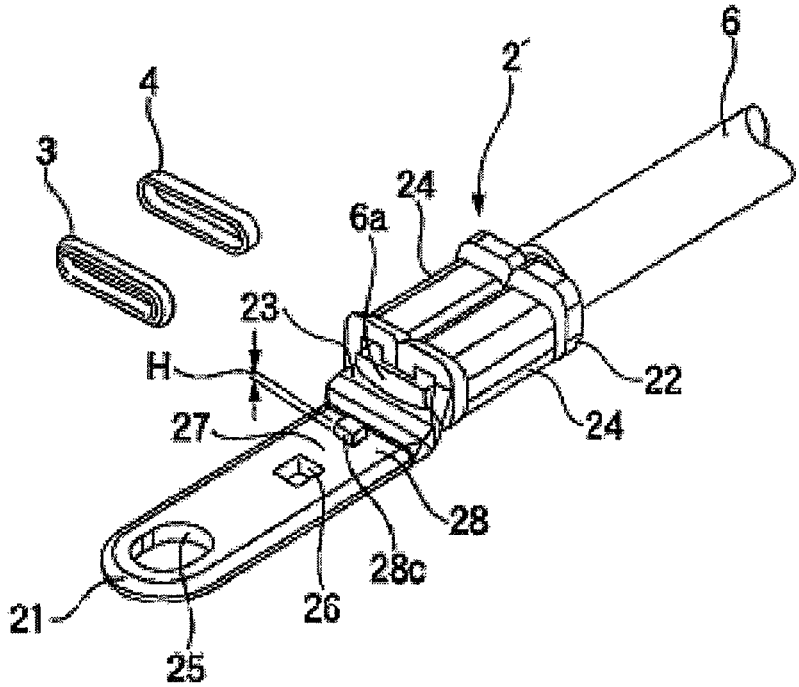
FIG. 5 is an expanded perspective view of a modified example of a connector terminal shown in FIG. 1.
Figure 6:
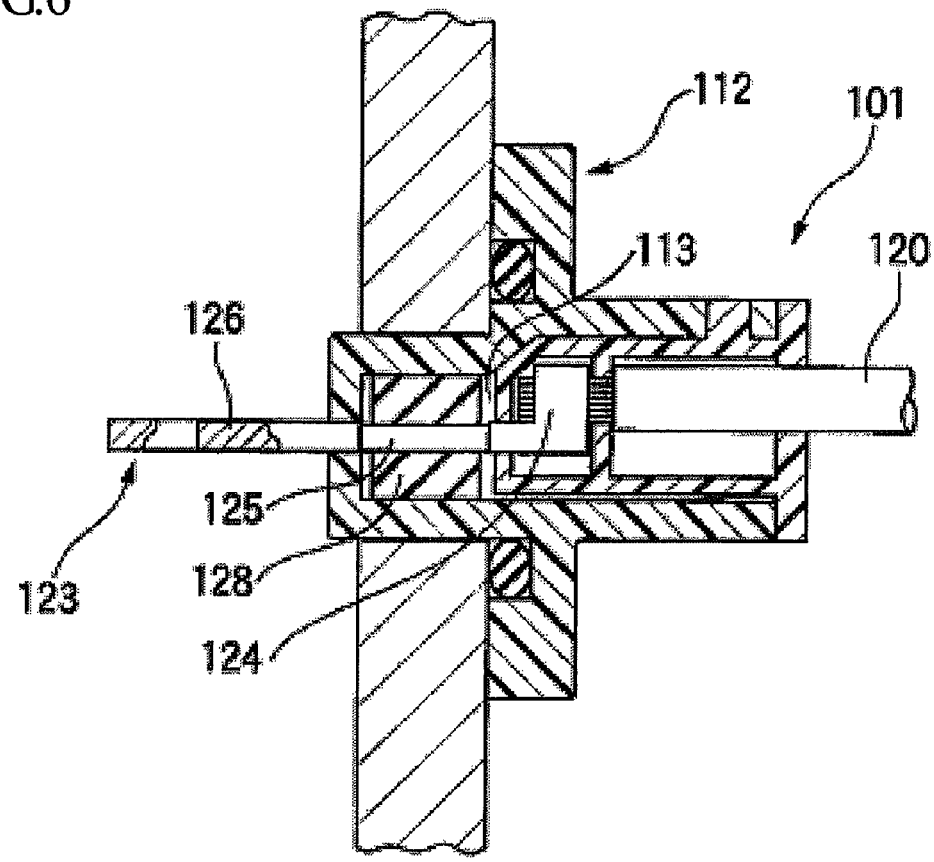
FIG. 6 is a sectional view of a related art connector.

FIG. 5 shows a modification of the above described terminal 2. The terminal 2' is configured that the engagement portion 28 of the electrical connector 21 is a projection 28*c* which is projected in a predetermined height from the basal portion of the electrical connector 21 in the thickness direction of the electrical connector 21. According to this configuration, it is possible to maintain the amount of the allowable current, prevent terminal from growing in size, and reduce the cost for the manufacturing.

The invention claimed is:

1. A terminal comprising:

an electrical connector including an engagement portion and an equipment portion and configured to be connected with an electric wire;

a ring shaped support member intimately attached to an outer periphery of the equipment portion and having a side abutting the engagement portion so that the support member is retained by the engagement portion; and a ring shaped elastic seal intimately attached to the outer periphery of the equipment portion and adjacent to the support member from a side of the support member opposite the side abutting the engagement portion, wherein a rigidity of the support member is higher than a rigidity of the elastic seal.

2. The terminal according to claim 1, wherein the electrical connector has a plate shape.

3. The terminal according to claim 2, wherein the engagement portion includes a projection which projects from a side of the plate shaped electrical connector in a width direction.

4. The terminal according to claim 3, wherein the engagement portion includes a projection which projects from the plate shaped electrical connector in a thickness direction.

5. A connector comprising:

a terminal including an electrical connector, the electrical connector including an engagement portion and an equipment portion and configured to be connected with an electric wire;

a connector housing including a terminal space into which the terminal is inserted, the terminal space having an inner peripheral wall;

a ring shaped support member intimately attached to an outer periphery of the equipment portion and having a side abutting the engagement portion so that the support member is retained by the engagement portion; and a ring shaped elastic seal intimately attached to the outer periphery of the equipment portion and the inner peripheral wall, and adjacent to the support member from a side of the support member opposite the side abutting the engagement portion, wherein a rigidity of the support member is higher than a rigidity of the elastic seal.

6. The connector according to claim 5, wherein the electrical connector has a plate shape.

7. The connector according to claim 6, wherein the engagement portion includes a projection which projects from a side of the plate shaped electrical connector in a width direction.

8. The connector according to claim 6, wherein the engagement portion includes a projection, which projects from the plate shaped electrical connector in a thickness direction.

* * * * *